US009671101B2

(12) United States Patent
Lei et al.

(10) Patent No.: US 9,671,101 B2
(45) Date of Patent: Jun. 6, 2017

(54) LIGHTING DEVICE AND LUMINAIRE

(71) Applicant: PHILIPS LIGHTING HOLDING B.V., Eindhoven (NL)

(72) Inventors: Chengyong Lei, Shanghai (CN); Yan Xiong, Shanghai (CN); Bao Wang, Nanjing (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/907,061

(22) PCT Filed: Aug. 14, 2014

(86) PCT No.: PCT/EP2014/067378
§ 371 (c)(1),
(2) Date: Jan. 22, 2016

(87) PCT Pub. No.: WO2015/024844
PCT Pub. Date: Feb. 26, 2015

(65) Prior Publication Data

US 2016/0169498 A1 Jun. 16, 2016

(30) Foreign Application Priority Data

Aug. 21, 2013 (WO) ..... PCT/CN2013/000970
Nov. 23, 2013 (EP) ..... 13194173

(51) Int. Cl.
*F21V 29/67* (2015.01)
*F21V 29/76* (2015.01)
(Continued)

(52) U.S. Cl.
CPC ..... *F21V 29/673* (2015.01); *F21K 9/20* (2016.08); *F21K 9/23* (2016.08); *F21V 29/677* (2015.01);
(Continued)

(58) Field of Classification Search
CPC ..... F21V 29/02; F21V 29/673; F21V 29/677; F21V 29/763; F21K 9/20; F21K 9/23
See application file for complete search history.

(56) References Cited

U.S. PATENT DOCUMENTS 6,340,237 B1 1/2002 Koga et al.
7,144,135 B2 12/2006 Wall et al.
(Continued)

FOREIGN PATENT DOCUMENTS

CN 103307581 A 9/2013
DE 102007019074 A1 10/2008
(Continued)

*Primary Examiner* — Andrew Coughlin
*Assistant Examiner* — Nathaniel Lee

(57) ABSTRACT

Disclosed is a lighting device (1) comprising a housing (80), an air inlet (22) and an air outlet (24); a support structure (30) in said housing extending in between said air inlet and said air outlet, said support structure including a section (32) carrying at least one solid state lighting element (10); a conduit (20) from said air inlet to said air outlet such that the conduit extends over the support structure; and a fan (40) mounted in said conduit, wherein the fan is located closer to the air inlet than to the air outlet. A luminaire including such a lighting device is also disclosed.

14 Claims, 6 Drawing Sheets

(51) Int. Cl.

| | |
|---|---|
| ***F21K 9/20*** | (2016.01) |
| ***F21K 9/23*** | (2016.01) |
| *F21V 29/60* | (2015.01) |
| *F21Y 101/00* | (2016.01) |
| *F21Y 115/10* | (2016.01) |

(52) U.S. Cl.
CPC ..... *F21V 29/763* (2015.01); *F21Y 2101/00* (2013.01); *F21Y 2115/10* (2016.08)

(56) References Cited

U.S. PATENT DOCUMENTS

| | | | | |
|---|---|---|---|---|
| 7,524,089 | B2 | 4/2009 | Park | |
| 2003/0038291 | A1 | 2/2003 | Cao | |
| 2005/0111234 | A1 | 5/2005 | Martin et al. | |
| 2005/0174780 | A1 | 8/2005 | Park | |
| 2006/0193139 | A1 | 8/2006 | Sun et al. | |
| 2007/0091632 | A1* | 4/2007 | Glovatsky ..... | B60Q 1/0052 362/547 |
| 2007/0115656 | A1 | 5/2007 | Chou et al. | |
| 2008/0212333 | A1 | 9/2008 | Chen | |
| 2009/0109625 | A1 | 4/2009 | Booth et al. | |
| 2009/0323361 | A1 | 12/2009 | Liu | |
| 2012/0032588 | A1 | 2/2012 | Lin et al. | |
| 2012/0170270 | A1 | 7/2012 | Kemps et al. | |
| 2013/0094226 | A1 | 4/2013 | Huang et al. | |

FOREIGN PATENT DOCUMENTS

| | | | |
|---|---|---|---|
| DE | 102007043961 | A1 | 3/2009 |
| JP | 7038982 | A | 2/1995 |
| JP | 2010520602 | A | 6/2010 |
| JP | 2011175976 | A | 9/2011 |
| SU | 1441135 | A1 | 11/1988 |
| SU | 1772516 | A1 | 10/1992 |
| WO | 2008086665 | A1 | 7/2008 |
| WO | 2008099818 | A1 | 8/2008 |
| WO | 2009040703 | A2 | 4/2009 |
| WO | 2009149121 | A2 | 12/2009 |

* cited by examiner

LIGHTING DEVICE AND LUMINAIRE

CROSS-REFERENCE TO PRIOR APPLICATIONS

This application is the U.S. National Phase application under 35 U.S.C. §371 of International Application No. PCT/EP2014/067378, filed on Aug. 14, 2014, which claims the benefit of European Patent Application No. 13194173.4, filed on Nov. 23, 2013 and of International Application No. PCT/CN2013/000970, filed on Aug. 21, 2013. These applications are hereby incorporated by reference herein.

FIELD OF THE INVENTION

The present invention relates to a lighting device comprising at least one solid state lighting (SSL) element and a cooling fan for cooling the at least one SSL element.

The present invention further relates to a luminaire including such a lighting device.

BACKGROUND OF THE INVENTION

Solid state lighting (SSL) is rapidly becoming the norm in many lighting applications. This is because SSL elements such as light emitting diodes (LEDs) exhibit superior lifetime and energy consumption compared to traditional alternatives such as incandescent and fluorescent lighting devices, e.g. light bulbs.

However, there are still difficulties to overcome in order to improve customer satisfaction and increase market penetration. For instance, SSL-based devices are often perceived to create light that is less aesthetically pleasing compared to traditional alternatives. Also, variations in the light produced by SSL-based lighting devices can be unsatisfactory. Such variations for instance can occur when the thermal management of the SSL elements of the device is insufficient, such that the operating temperature of the SSL elements may vary, which can alter the colour point produced by the SSL elements, as the colour point typically is a function of the operating temperature of the SSL elements.

Such thermal management challenges are particularly prevalent when designing high-power SSL-based lighting devices, e.g. high-power LED lamps. Quite often the scaling up of the heat sink for dissipating the heat generated by the one or more SSL elements is either insufficient or practically impossible due to the restricted volumes in which the heat sink needs to be placed, e.g. inside the inner volume of a standard size light bulb.

This has seen the emergence of lighting devices including one or more SSL elements in which a cooling fan is integrated in the design of the lighting device to force air over the SSL element, thereby reducing the heat dissipation requirement of heat sinks in the design of the lighting device.

An example of a lighting device including such a cooling fan is disclosed in EP 2 597 352 A1, which LED light source includes a first housing containing a LED board, a second housing containing an LED control part, and a connecting member that connects the first housing and the second housing to each other. The LED light source further comprises a fan mechanism provided between the first housing and the second housing, heat dissipation fins provided around the fan mechanism in the first housing and an air path of which one end opening is formed at a position facing to an air inlet side of the fan mechanism in the second housing and the other opening formed on a surface different from an opposed surface of the second housing.

However, the placement of such a fan in the direct vicinity of the LED elements (or other SSL elements) is not without problems. The heat generated by the SSL elements can reduce the lifetime of the fan and the lighting device as a whole. In order to avoid this, the capacity of the fan may be increased, but this typically also increases the noise levels of the fan, which may be unacceptable from a consumer satisfaction point of view.

Moreover, the position of the air inlets and outlets in this LED light source is far from ideal, especially when the light source is to be mounted in a closed luminaire, where the close vicinity of the walls of the luminaire to the air inlet and outlets may severely restrict the air flow, which can lead to insufficient cooling of the light source.

US2006/193139A1, DE102007043961A1, US2009/323361A1, US2003/038291A1 and US2012/032588A1 each discloses a fan configuration in a lighting device.

SUMMARY OF THE INVENTION

The present invention seeks to provide a lighting device in which at least some of these issues have been addressed.

The present invention further seeks to provide a luminaire including such a lighting device.

According to an aspect, there is provided a lighting device comprising a housing, an air inlet and an air outlet; a support structure in said housing extending in between said air inlet and said air outlet, said support structure including a section carrying at least one solid state lighting element; a conduit from said air inlet to said air outlet such that the conduit extends over the support structure; and a fan mounted in said conduit, wherein the fan is located closer to the air inlet than to the air outlet, and wherein the support structure has a first slanted surface portion extending from the air inlet to said section and a second slanted surface portion extending from said section to the air outlet, wherein the fan is mounted on the first slanted surface portion such that the fan is slanted relative to said section.

Placement of the fan in such a slanted orientation improves the utilization of the inner space of the lighting device. Diameter of the fan in such a slanted orientation may be maximized, which facilitates the generation of an increased air flow at reduced noise levels. Moreover, it has been found that the provision of such a slanted support structure and the placement of the fan on a slanted surface portion, the build-up of dust in the conduit is reduced, thus further improving the lifetime of the lighting device.

By moving the fan away from the section of the carrier on which the at least one SSL element is mounted, the thermal coupling between the fan and the at least one SSL element is reduced. This allows for the use of smaller fans compared to prior art arrangements in which the fan is mounted in close vicinity to the SSL elements, e.g. directly above or under such elements, in which case the fan itself can become overheated as previously explained.

The lighting device may have a central axis extending through said section, wherein the fan is mounted away from said central axis.

In an embodiment, the air inlet and the air outlet are located in a same surface of the lighting device.

Said surface may further comprise a light exit window separating the air inlet from the air outlet, wherein the at least one solid state lighting element is carried by said section such that the least one solid state lighting element is located in between the support structure and the light exit window. This embodiment effectively provides a conduit from one side to an opposite side of the support structure, such that the full length of the support structure can be cooled by the air stream forced over the support structure by the fan. Moreover, this arrangement can be advantageously used in closed luminaires as the air inlet and air outlet are positioned next to the light exit window, and are therefore left exposed in such closed luminaires, e.g. track luminaires.

The support structure may be a heat sink assisting the cooling of the at least one SSL element.

In an embodiment, said section comprises a first surface carrying the at least one solid state lighting element and a second surface opposite the first surface, said second surface carrying a plurality of fins extending into the conduit, wherein the fan is arranged in between the air inlet and the plurality of fins. This further improves the heat dissipation for the at least one SSL element, as the fins increase the effective surface area of the heat sink and the fan remains thermally decoupled from the heat sink.

The plurality of fins may extend over the air outlet to optimise the surface area of these fins.

The heat sink may further comprise a pair of air guide members on opposite sides of at least a part of said conduit to define the conduit and ensure that the air stream is forced through the channels defined by the fins.

The support structure may comprise a circular slanted surface around said section, said circular slanted surface including the first slanted surface portion and the second slanted surface portion. For instance, the support structure may have a truncated conical shape.

In an embodiment, the lighting device further comprises a driver circuit and a further heat sink for cooling said driver circuit, wherein the further heat sink is located opposite said section and separated from said section by said conduit. This has the advantage that the single conduit provides efficient cooling for both the at least one SSL element and the driver circuit without overheating the fan.

The at least one solid state lighting element preferably is a light emitting diode such as an organic or inorganic LED.

The lighting device may be a light bulb such as a MR16, Par30, Par38, BR30, BR40, GU10 or AR111 type light bulb and so on. Any suitable type or size light bulb may be considered.

In accordance with another aspect, there is provided a luminaire including the lighting device according to an embodiment of the present invention. The luminaire may for instance be a track luminaire. Such a luminaire benefits from the inclusion of the lighting device according to an embodiment of the present invention in that the lighting device can still be effectively cooled whilst mounted in the luminaire. This improves the customer satisfaction of the luminaire, as the customer will not be annoyed by the relative frequent failure of lighting devices in the luminaire because of the luminaire restricting air flow through the lighting device.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
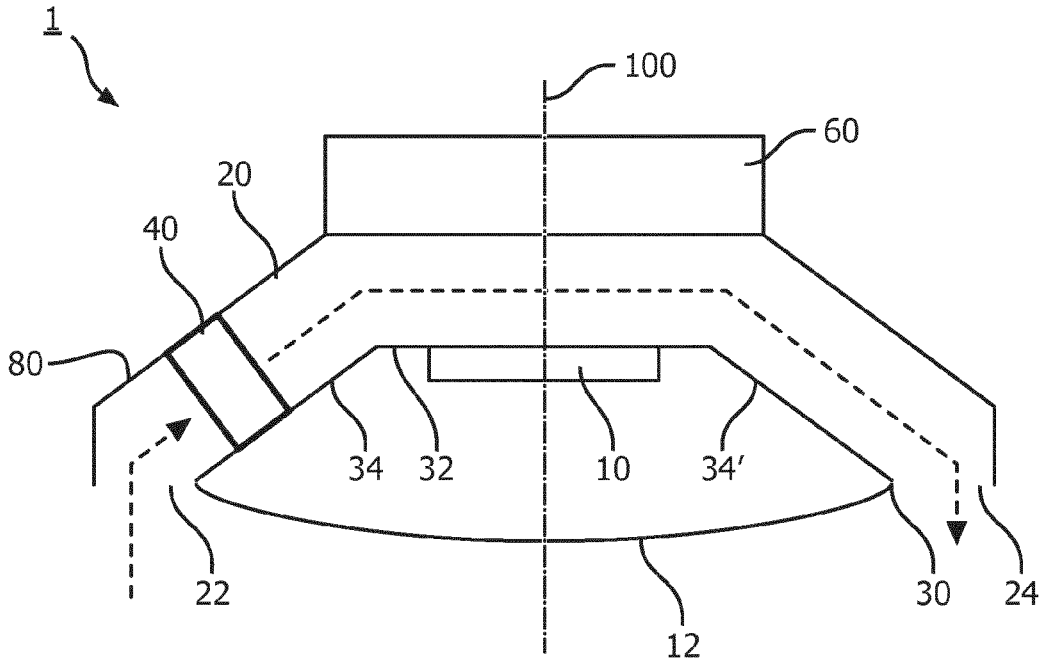
FIG. 1 schematically depicts a cross-section of a lighting device according to an embodiment of the present invention.

It should be understood that the Figures are merely schematic and are not drawn to scale. It should also be understood that the same reference numerals are used throughout the Figures to indicate the same or similar parts.

FIG. 1 schematically depicts a cross section of a lighting device 1 according to an embodiment. The lighting device 1 may for instance be a light bulb or any other suitable lighting device. The lighting device 1 comprises a support structure 30 onto which one or more SSL elements 10 are mounted such that the luminous output of the one or more SSL elements 10 is directed towards a light exit window 12 of the lighting device 1. The one or more SSL elements 10 may for instance be LEDs, e.g. inorganic or organic LEDs. Although not shown specifically, the lighting device 1 may further or alternatively comprise one or more reflective elements for redirecting the luminous output of the one or more SSL elements 10 towards the light exit window 12.

The light exit window 12 typically is a transparent or a translucent portion of the lighting device 1, and may be made of any suitable material, e.g. glass or a sufficiently transparent polymer such as an optical grade polycarbonate or poly methyl methacrylate (PMMA). Although not specifically shown, the light exit window may additionally or alternatively comprise one or more optical elements such as a diffuser, a lens or microlens array and so on.

In an embodiment, the support structure 30 comprises a central section 32 onto which the one or more SSL elements 10 are mounted and a first slanted section 34 and a second slanted section 34' such that the central section is located in between the first slanted section 34 and the second slanted section 34'. The support structure 30 may cooperate with the light exit window 12 to define a cavity in which the at least one SSL element 10 is located.

Figure 2:
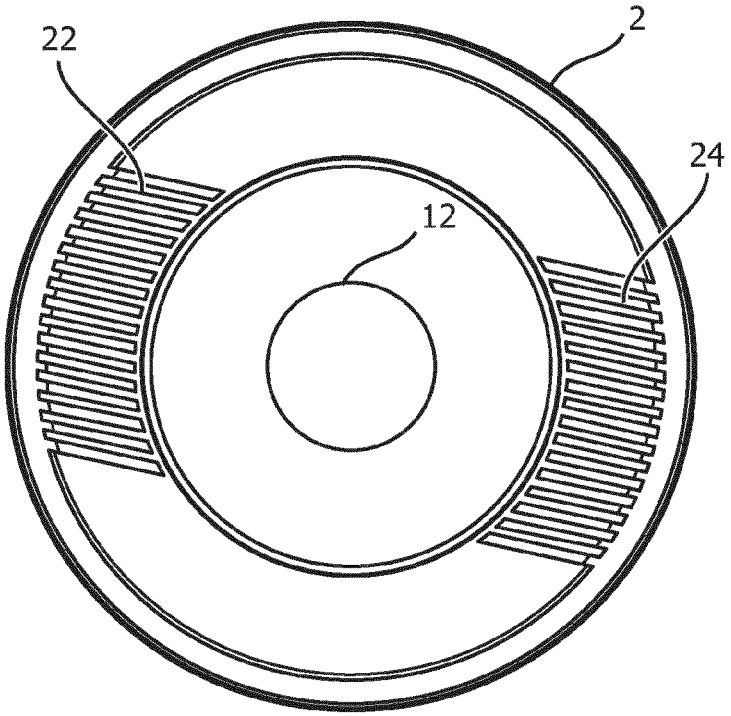
FIG. 2 schematically depicts a surface of a lighting device according to an embodiment of the present invention.

The support structure 30 further defines a part of a conduit 20 comprising an air inlet 22 and an air outlet 24. In an embodiment, the conduit 20 may be further defined by part of the housing 80 of the lighting device 1. The housing 80 may be made of any suitable material, e.g. glass or a suitable polymer material. As shown in FIG. 2, the air inlet 22 and the air inlet 24 may be located in the same surface 2 of the lighting device 1, which preferably is the surface further including the light exit window 12 such that the air inlet 22 and air outlet 24 will always be exposed even when mounted in a luminaire as will be explained in more detail later. As shown in FIG. 2, the air inlet 22 and air outlet 24 may be shaped to include a plurality of slits such that large objects cannot enter the conduit 20. This for instance prevents a user of the lighting device 1 from accidentally jamming a finger or another large object into the air inlet 22 or the air outlet 24.

A fan 40 is placed in the conduit 20 to force air from the air inlet 22 to the air inlet 24. The fan 40 is mounted such that it is located nearer the air inlet 22 than the air outlet 24. To this end, the fan 40 may for instance be mounted away from the central axis 100 of the lighting device 1. In an embodiment, the fan 40 is placed in between the central section 32 of the support structure 30 and the air inlet 22. By avoiding placement of the fan 40 on the central section 32, large thermal coupling between the fan 40 and the at least one SSL element 10 is avoided. In an embodiment, the fan 40 is mounted on the first slanted section 34 such that the fan 40 is slanted or tilted relative to the central section 32 of the support structure 30. This arrangement is particularly suited to reduce the intake of dust by the lighting device 1, thereby increasing the lifetime of the lighting device 1.

The air flow rate CFM to be produced by the fan 40 may be calculated using the following formula:

$$Q=c_p m\Delta T=c_p\times CFM\times\rho\times\Delta T, \text{ such that } CFM=Q/(c_p=\rho=\Delta T)$$

In this formula, Q is the heat dissipation power of air, $c_p$ is the constant pressure specific heat of air; ρ is the air density and ΔT is the temperature difference between the air entering the air inlet 22 and the air exiting the air outlet 24. Consequently, the fan 40 may be dimensioned based on the amount of heat generated by the at least one SSL element 10 and its driver circuit. In this embodiment, the conduit 20 may further be defined in part by a further heat sink 60 for dissipating the heat of the driver circuit, as will be explained in more detail later.

Figure 3:
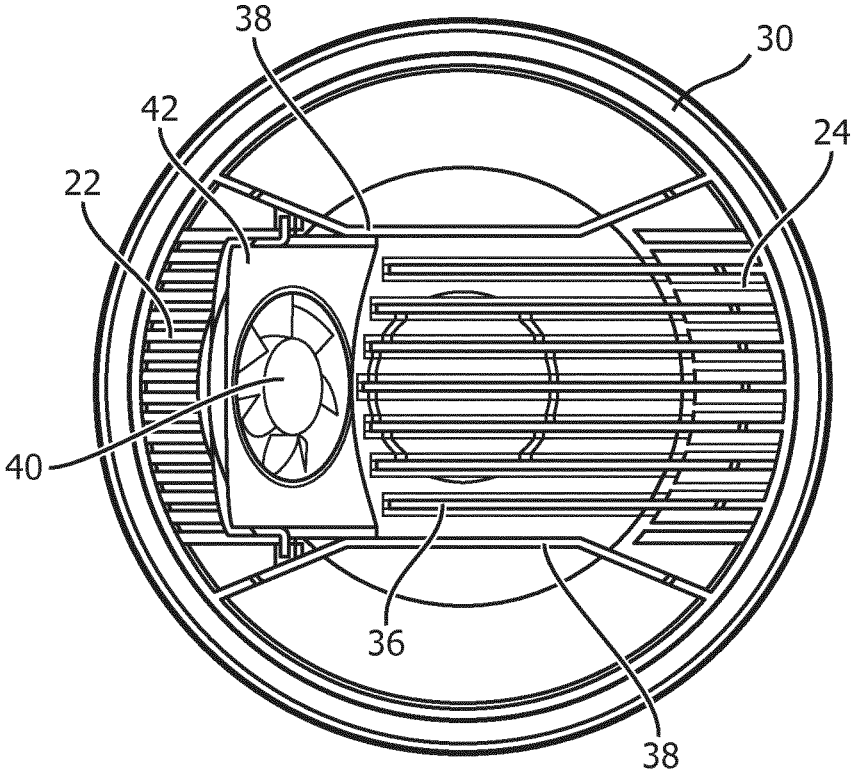
FIG. 3 schematically depicts a top view of an aspect of a lighting device according to an embodiment of the present invention.
Figure 4:
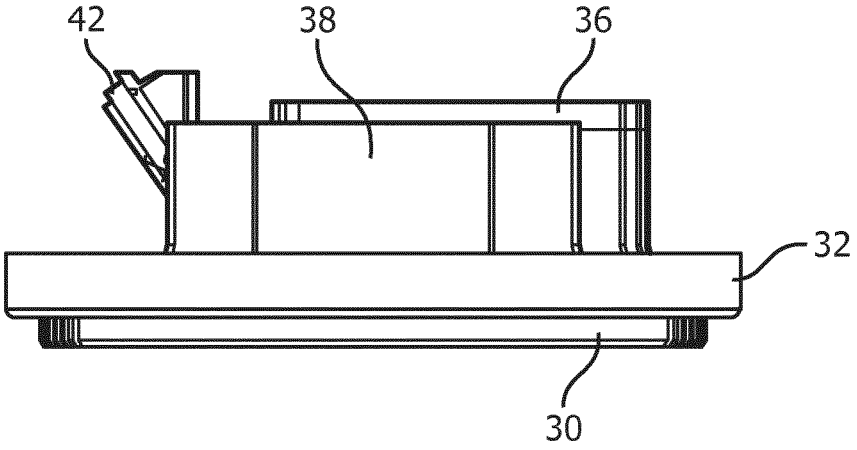
FIG. 4 schematically depicts a cross-section of the aspect shown in FIG. 3.
Figure 5:
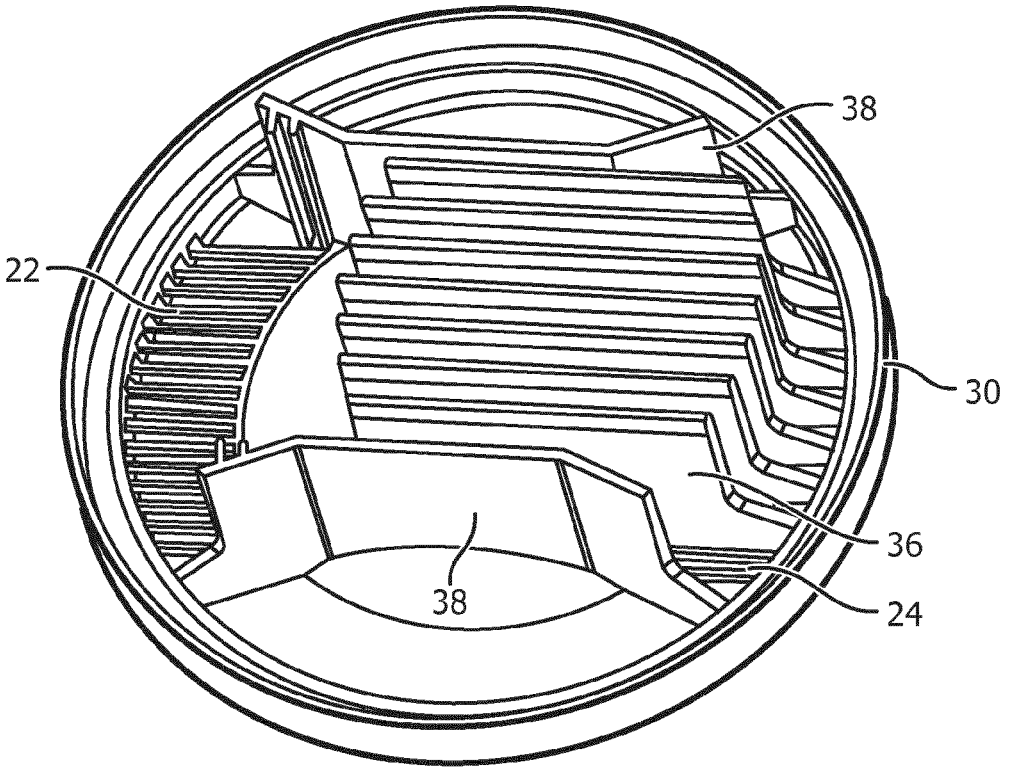
FIG. 5 schematically depicts a perspective view of the aspect shown in FIG. 3.

In an embodiment, at least the central section 32 of the support structure 30 defines a heat sink for the at least one SSL element 10. FIG. 3 schematically depicts a top view, FIG. 4 schematically depicts a cross-section and FIG. 5 schematically depicts a perspective view of a non-limiting example of such a heat sink arrangement. In this embodiment, the support structure 30 comprises a plurality of fins 36 that when assembled in the lighting device 1 is located inside the conduit 20. The fan 40 and its holder 42 are located in between the fins 36 and the air inlet 22, with the fan 40 preferably being tilted respective to the plane on which the fins 36 are mounted, as is most clearly recognizable in FIG. 4.

The fins 36 may at least partially extend over the air outlet 24. This not only increases the effective surface area of the heat sink of the at least one SSL element 10 but furthermore assists in effectively guiding the air flow through the conduit 20 towards the air outlet 24. The support structure 30 may further comprise a pair of air guide members 38 on opposite sides of the fins 36. The air guide members 38 may force the incident air through the fins 36 to ensure effective heat transfer between the fins 36 and the air flow. The air guide members 38 may extend from the air inlet 22 to the air outlet 24 and may define side walls of the air conduit 20.

The support structure 30 may be made of any suitable thermally conductive material, e.g. a thermally conductive metal such as aluminium.

Figure 6:
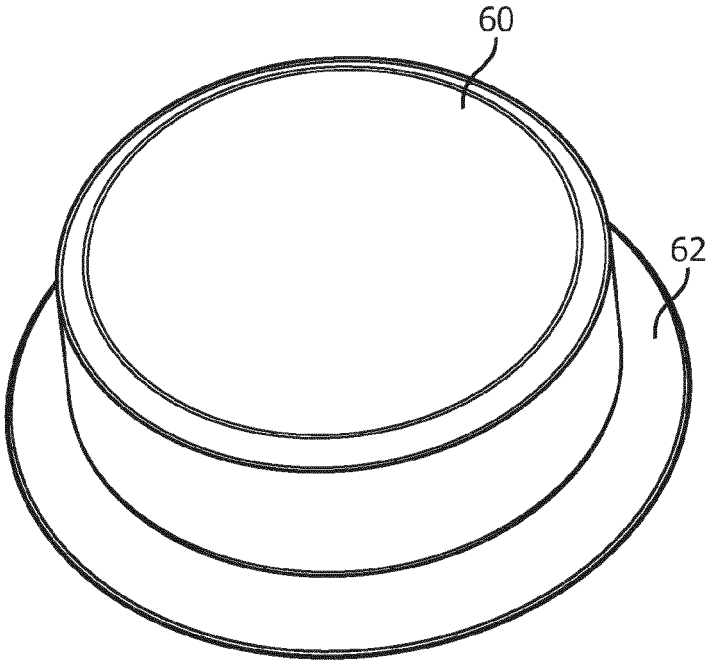
FIG. 6 schematically depicts a perspective view of another aspect of a lighting device according to an embodiment of the present invention.
Figure 7:
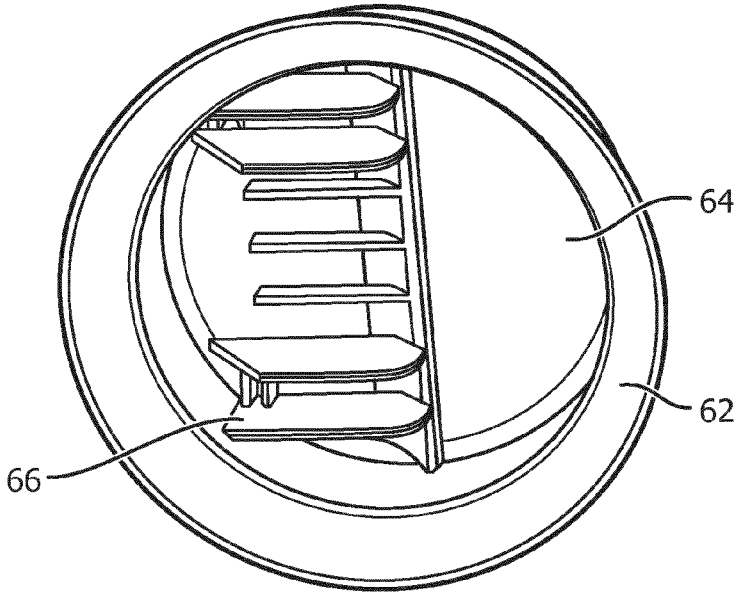
FIG. 7 schematically depicts another perspective view of the aspect of a lighting device shown in FIG. 6.

In an embodiment, the lighting device 1 may comprise a separate heat sink 60 for the driver circuit of the at least one SSL element 10. A non-limiting example embodiment of such a further heat sink 60 is shown in FIG. 6, which schematically depicts a top view of the further heat sink 60 and in FIG. 7, which schematically depicts a bottom view of the further heat sink 60. When assembled in the lighting device 1, the bottom of the further heat sink 60 faces the conduit 20. The further heat sink 60 may for instance be cup-shaped or hat-shaped such that it contains a cavity 64 facing the conduit 20. The cavity 64 may house a number of further fins 66 to increase the effective surface area of the further heat sink 60 and promote the heat transfer of the heat generated by the driver circuit to the air flowing through the conduit 20. This is particularly advantageous if the support structure 30 comprises a plurality of fins 36 such that the lighting device 1 may be assembled without having to align the fins 36 with the further fins 66 in the conduit, as the fins 36 and the further fins 66 are not spatially overlapping.

The further heat sink 60 may comprise a rim 62 for thermally coupling the further heat sink 60 to the driver circuit. The further heat sink 60 may be made of any suitable thermally conductive material, e.g. a thermally conductive metal such as aluminium.

Figure 8:
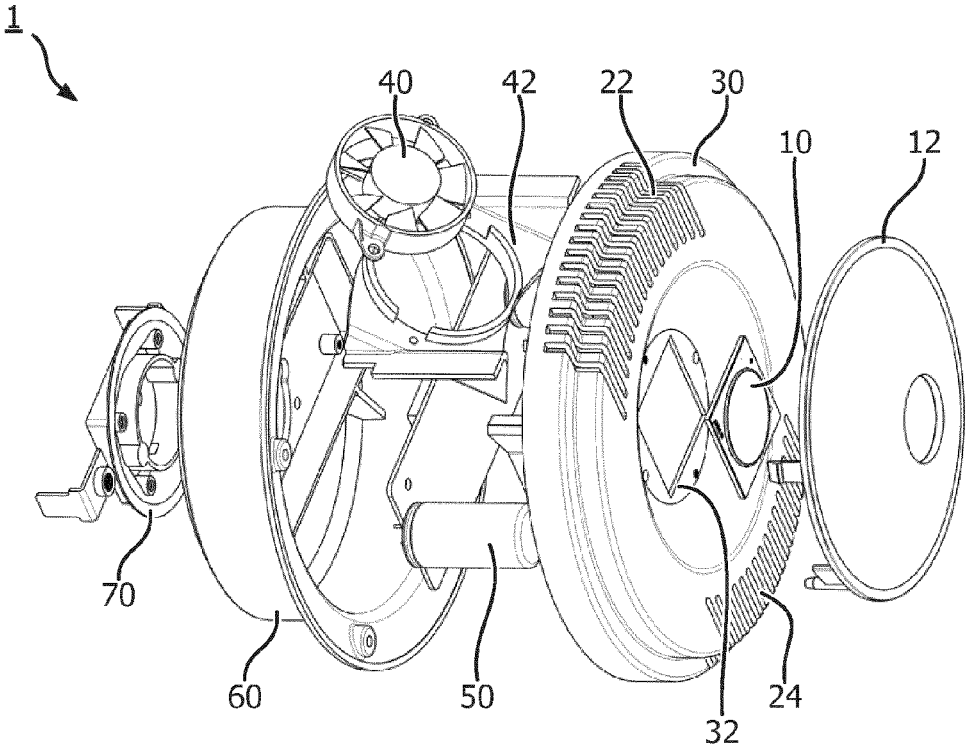
FIG. 8 schematically depicts an exploded view of a lighting device according to an embodiment of the present invention.

FIG. 8 schematically shows an exploded view of a lighting device 1 in accordance with an embodiment of the present invention. Of particular note is the presence of the air inlet 22 and the air outlet 24 in the support structure 30, which further is arranged to receive the light exit window 12 and the at least one SSL element 10 in its central section 32. The at least one SSL element 10 may for instance further include a printed circuit board or another suitable carrier carrying any suitable number of LEDs.

Upon assembly, the light exit window 12, the air inlet 22 and the air outlet 24 are all facing the same direction, such that upon fitting of the lighting device 1 in a luminaire, the light exit window 12, the air inlet 22 and the air outlet 24 are facing the opening in the luminaire such that the luminaire does not restrict the air flow through the air inlet 22 and the air inlet 24, as will be explained in more detail later. It is noted for the avoidance of doubt that the air inlet 22 and the air inlet 24 are included in the support structure 30, e.g. the heat sink, of the at least one SSL element 10 by way of non-limiting example only. It is for instance equally feasible to include the air inlet 22 and the air outlet 24 into a separate housing of the lighting device 1.

The fan holder 42 including the fan 40 is mounted on the support structure 30. As explained before, the fan holder 42 including the fan 40 is preferably mounted under an angle, e.g. slanted or tilted, respective to the central section 32 of the support structure 30. The fan 40 is mounted such that it is closer to the air inlet 22 than to the air outlet 24. A driver circuit 50 may also be mounted on the support structure 30 and thermally coupled to a further heat sink 60. The lighting device 10 may be completed using any further suitable components, such as for instance a shell 70.

At this point it is emphasized that the conduit 20 in the lighting device 1 may have any suitable shape, although it is preferred that the air inlet 22 and the air outlet 24 are located adjacent to the light exit window 12 such that the air inlet 22 and the air outlet 24 cannot be blocked when the lighting device is fitted in a luminaire that has no openings in its one or more walls, as previously explained.

Figure 9:
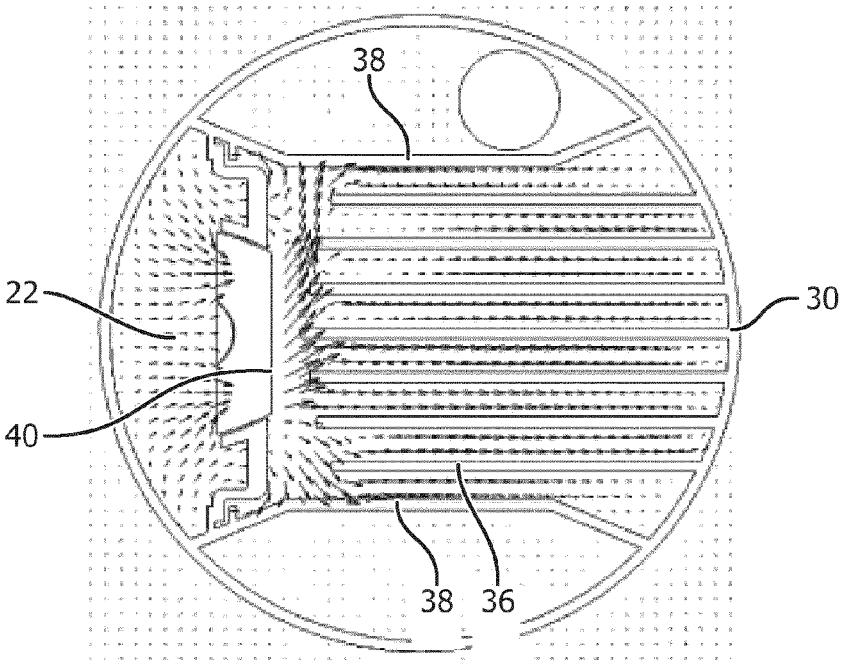
FIG. 9 schematically depicts a simulation result of an air flow through a cross-section of a lighting device according to an embodiment of the present invention.
Figure 10:
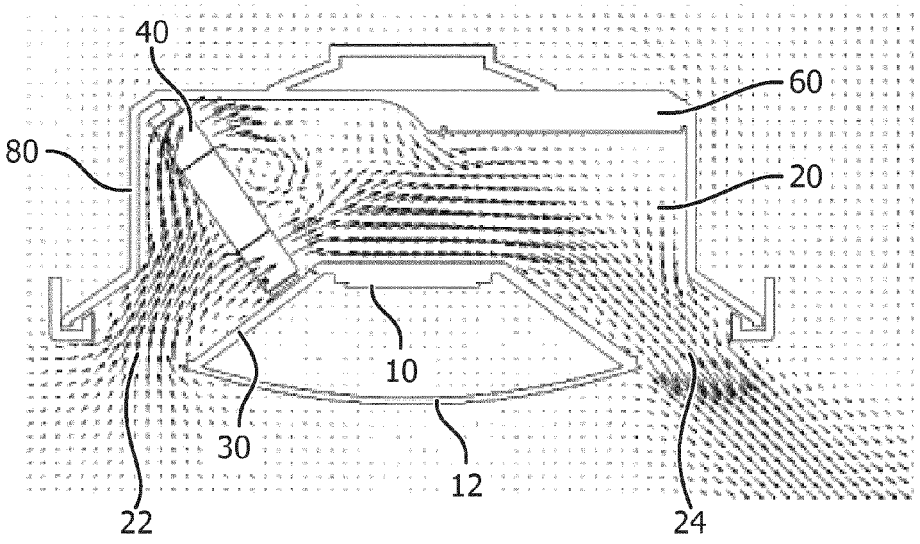
FIG. 10 schematically depicts a simulation result of an air flow through another cross-section of a lighting device according to an embodiment of the present invention.
Figure 11:
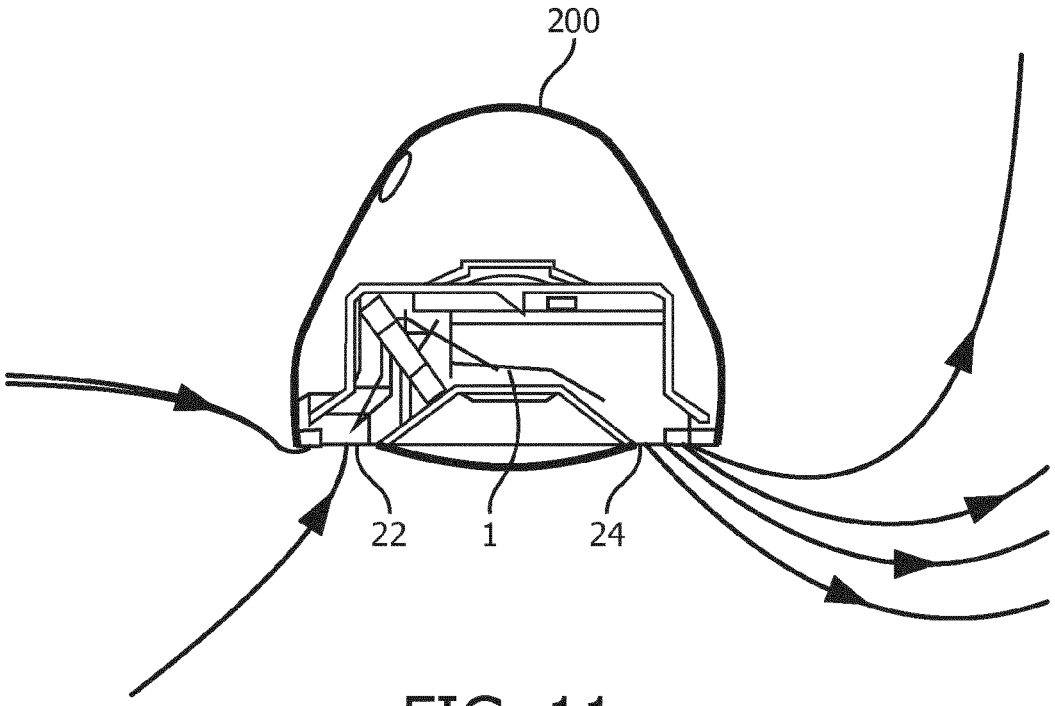
FIG. 11 schematically depicts a cross-section of a luminaire according to an embodiment of the present invention.

FIG. 9 (top view) and FIG. 10 (cross-section) depict the results of air flow simulations through the conduit 20 of the lighting device 1 when placed in the closed luminaire 200 as shown in FIG. 11. The arrows in FIGS. 9 and 10 indicate the velocity vectors of the air flowing through the conduit 20. As before, the conduit 20 extends from the air inlet 22 to the air outlet 24 and is defined by the support structure 30 acting as a heat sink for the at least one SSL element 10 facing the light exit window 12, housing 80 and further heat sink 60 for the driver circuit of the at least one SSL element 10. The support structure 30 further includes the fins 36 and air guide members 38, with the fan 40 being mounted on a slanted surface of the support structure 30 in between the air inlet 22 and the fins 36.

The location of the air inlet 22 and the air outlet 24 adjacent to the light exit window 12 such that the air inlet 22, the air outlet 24 and the light exit window 12 are located in the same surface or face of the lighting device 1 ensures that the air circulation through the conduit 20 is not impeded when the lighting device 1 is fitted in the luminaire 200, as demonstrated by the velocity vectors in FIGS. 9 and 10. The arrows in FIG. 11 indicate the flow trajectories of the air into and out of the lighting device 1. These arrows also clearly indicate that the air inlet 22 and the air outlet 24 are unimpeded by the luminaire 200. The luminaire 200 may for instance be a track luminaire, e.g. a spot light for fitting on a track system (not shown).

In some embodiments, the conduit 20 may have a non-constant cross section, as for instance is apparent from FIG. 10 and FIG. 11, where the entry section of the conduit 20 connecting to the air inlet 22 and the exit section of the conduit 20 connecting to the air outlet 24 each have a smaller cross section than the intermediate section of the conduit 20 delimited by the entry section on the one side and the exit section on the other side. For instance, in FIG. 10 and FIG. 11 this intermediate section is delimited by the vertical sections of the housing 80, the further heat sink 60 and the at least one SSL element 10. Moreover, the intermediate section may have an oblique shape, for instance because the further heat sink 60 does not extend over the full width of the upper section of the housing 80, as shown in FIG. 10 and FIG. 11. In a particular advantageous embodiment, the fan 40 is mounted in the intermediate section of the conduit 20 in a slanted fashion. In case of the intermediate section having an oblique shape, the fan 40 preferably is mounted in a slanted fashion in the portion of the oblique intermediate section having the largest cross-section. This has the advantage that the diameter of the fan 40 in such a slanted orientation can be maximized, which facilitates the generation of an increased air flow at reduced noise levels. This reduces the risk of user dissatisfaction because of perceived unacceptable noise levels associated with the operation of the lighting device 1, with the higher air flow also improving the efficiency of the cooling of the lighting device 1, which therefore improves the lifetime of the lighting device 1.

Furthermore, placement of the fan 40 in such a slanted orientation within the larger intermediate section of the conduit 20 improves the utilization of the inner space of the lighting device 1, such as the larger corner of the oblique intermediate section of the conduit 20 in the lighting device 1, as shown in FIG. 10 and FIG. 11. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a housing;

an air inlet and an air outlet;

a support structure in said housing extending in between said air inlet and said air outlet, said support structure including a section carrying at least one solid state lighting element and defining a light exit window, wherein the air inlet, the air outlet, and the light exit window face a same direction;

a conduit from said air inlet to said air outlet such that the conduit extends over the support structure; and a fan mounted in said conduit, wherein the fan is located closer to the air inlet than to the air outlet;

wherein the support structure has a first slanted surface portion extending from the air inlet to said section and a second slanted surface portion extending from said section to the air outlet, wherein the fan is mounted on the first slanted surface portion such that the fan is slanted relative to said section.

2. The lighting device of claim 1, having a central axis extending through said section, wherein the fan is mounted away from said central axis.

3. The lighting device of claim 1, wherein the air inlet and the air outlet are located in a same surface of the lighting device.

4. The lighting device of claim 3, wherein said light exit window separates the air inlet from the air outlet, and wherein the at least one solid state lighting element is carried by said section such that the least one solid state lighting element is located in between the support structure and the light exit window.

5. The lighting device of claim 1, wherein the support structure is a heat sink.

6. The lighting device of claim 5, wherein said section comprises a first surface carrying the at least one solid state lighting element and a second surface opposite the first surface, said second surface carrying a plurality of fins extending into the conduit, wherein the fan is arranged in between the air inlet and the plurality of fins.

7. The lighting device of claim 6, wherein the plurality of fins extend over the air outlet.

8. The lighting device of claim 5, wherein the heat sink comprises a pair of air guide members on opposite sides of at least a part of said conduit.

9. The lighting device of claim 1, further comprising a driver circuit and a further heat sink for cooling said driver circuit, wherein the further heat sink is located opposite said section and separated from said section by said conduit.

10. The lighting device of claim 1, wherein the solid state lighting element is a light emitting diode.

11. The lighting device of claim 1, wherein the lighting device is a light bulb.

12. A luminaire including the lighting device of claim 1.

13. The luminaire of claim 12, wherein the luminaire is a track luminaire.

14. A lighting device comprising:

a housing;

an air inlet and an air outlet;

a support structure in said housing extending in between said air inlet and said air outlet, said support structure including a section carrying at least one solid state lighting element;

a conduit from said air inlet to said air outlet such that the conduit extends over the support structure; and a fan mounted in said conduit, wherein the fan is located closer to the air inlet than to the air outlet;

wherein the support structure has a first slanted surface portion extending from the air inlet to said section and a second slanted surface portion extending from said section to the air outlet, wherein the fan is mounted on the first slanted surface portion such that the fan is slanted relative to said section; and wherein the support structure comprises a circular slanted surface around said section, said circular slanted surface including the first slanted surface portion and the second slanted surface portion.

* * * * *